US009260232B2

(12) United States Patent
Kooc et al.

(10) Patent No.: US 9,260,232 B2
(45) Date of Patent: Feb. 16, 2016

(54) RECLOSABLE MULTI-PART BLISTER

(75) Inventors: Linh Li Kooc, Richmond, VA (US); Charlotte Hanks, Toronto (CA); Kyle Schumaker, Greer, SC (US)

(73) Assignee: WestRock MWV, LLC, Norcross, GA (US)

( * ) Notice: Subject to any disclaimer, the term of this patent is extended or adjusted under 35 U.S.C. 154(b) by 0 days.

(21) Appl. No.: 14/238,115

(22) PCT Filed: Jul. 23, 2012

(86) PCT No.: PCT/US2012/047788

§ 371 (c)(1),
(2), (4) Date: Feb. 10, 2014

(87) PCT Pub. No.: WO2013/028299

PCT Pub. Date: Feb. 28, 2013

(65) Prior Publication Data

US 2014/0166525 A1 Jun. 19, 2014

Related U.S. Application Data

(60) Provisional application No. 61/527,400, filed on Aug. 25, 2011.

(51) Int. Cl.
*B65D 73/00* (2006.01)
*B65D 75/52* (2006.01)

(52) U.S. Cl.
CPC ..... *B65D 75/52* (2013.01); *B65D 73/0092* (2013.01); *B65D 2575/586* (2013.01)

(58) Field of Classification Search
CPC ..... B65D 73/0092; B65D 73/0085
USPC ..... 206/464, 463, 462, 469, 461, 470
See application file for complete search history.

(56) References Cited

U.S. PATENT DOCUMENTS

| | | | | | |
|---|---|---|---|---|---|
| 2,796,985 | A | | 6/1957 | Gorton | |
| 3,044,618 | A | | 7/1962 | Surloff | |
| 3,144,343 | A | * | 8/1964 | Fritsche | B65D 75/28 206/216 |
| 3,178,019 | A | | 4/1965 | Fetzek | |
| 3,246,747 | A | * | 4/1966 | Blish | B65D 73/0092 206/462 |
| 3,352,409 | A | * | 11/1967 | Link | B65D 75/30 206/463 |
| 3,407,928 | A | * | 10/1968 | Watts, Jr. | B65D 73/0092 206/45.24 |
| 3,581,885 | A | | 6/1971 | Wald | |
| 3,695,417 | A | * | 10/1972 | Stoker, Jr. | B65D 75/20 206/365 |

(Continued)

FOREIGN PATENT DOCUMENTS

| | | | |
|---|---|---|---|
| DE | 9303242 | U1 | 7/1994 |
| DE | 20120503 | U1 | 4/2003 |

(Continued)

OTHER PUBLICATIONS

PCT/US2012/047788 International Search Report and Written Opinion, mailed Oct. 10, 2012.

(Continued)

*Primary Examiner* — Steven A. Reynolds
*Assistant Examiner* — King M Chu
(74) *Attorney, Agent, or Firm* — WestRock Intellectual Property Group

(57) ABSTRACT

A package (100) is disclosed which includes a blister with two halves (150,160) that rotate apart, the blister flanges being sealed within two paperboard cards (110, 120). The package may be opened by tearing across the paperboard cards, then rotating or tilting the blister halves apart.

18 Claims, 13 Drawing Sheets

(56) References Cited

U.S. PATENT DOCUMENTS

| | | | | | |
|---|---|---|---|---|---|
| 4,083,451 | A * | 4/1978 | Hair | B29C 65/02 | 206/461 |
| 4,270,659 | A | 6/1981 | Kuchenbecker | | |
| 4,705,163 | A | 11/1987 | James | | |
| 4,779,734 | A * | 10/1988 | Kydonieus | B65D 73/0092 | 206/467 |
| 4,981,213 | A * | 1/1991 | Dillon | B65D 75/305 | 206/462 |
| 5,251,757 | A * | 10/1993 | Relyea | B65D 83/0463 | 206/531 |
| 5,613,607 | A | 3/1997 | Kalmanides et al. | | |
| 6,050,415 | A * | 4/2000 | Lind | B65D 73/0092 | 206/462 |
| 6,308,832 | B1 * | 10/2001 | Pirro | B65D 73/0092 | 206/462 |
| 6,889,840 | B2 | 5/2005 | Schein et al. | | |
| 7,144,635 | B2 | 12/2006 | Hawes et al. | | |
| 7,513,369 | B1 | 4/2009 | Lee | | |
| 7,621,405 | B2 * | 11/2009 | Schweitzer | B65D 73/0092 | 206/463 |
| 2004/0182735 | A1 | 9/2004 | Lombardi et al. | | |
| 2008/0029419 | A1 * | 2/2008 | Appelbaum | B65D 75/321 | 206/463 |
| 2010/0170821 | A1 | 7/2010 | Grosskopf | | |
| 2012/0125796 | A1 | 5/2012 | Falcon | | |
| 2012/0228177 | A1 | 9/2012 | Schwester | | |
| 2013/0015197 | A1 | 1/2013 | Gauthier | | |
| 2013/0228488 | A1 | 9/2013 | Wu et al. | | |
| 2013/0319895 | A1 * | 12/2013 | Hanks | B65D 73/0057 | 206/463 |
| 2013/0327673 | A1 * | 12/2013 | Hanks | B65D 73/0092 | 206/488 |
| 2015/0021224 | A1 * | 1/2015 | Vossoughi | B65D 73/0057 | 206/469 |

FOREIGN PATENT DOCUMENTS

| | | | |
|---|---|---|---|
| FR | 1333755 | A | 8/1963 |
| WO | WO0187732 | A1 | 11/2001 |
| WO | WO0238470 | A1 | 5/2002 |
| WO | WO2008154566 | A1 | 12/2008 |
| WO | WO2011115762 | | 9/2011 |
| WO | WO2012067757 | | 5/2012 |

OTHER PUBLICATIONS

PCT/US2012/047788 Preliminary Report , mailed Feb. 25, 2014.

* cited by examiner

FIG. 8A
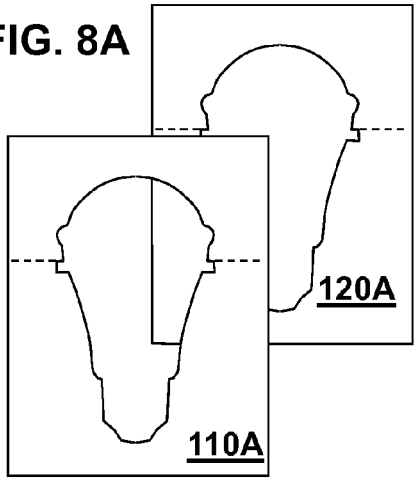
FIG. 8B
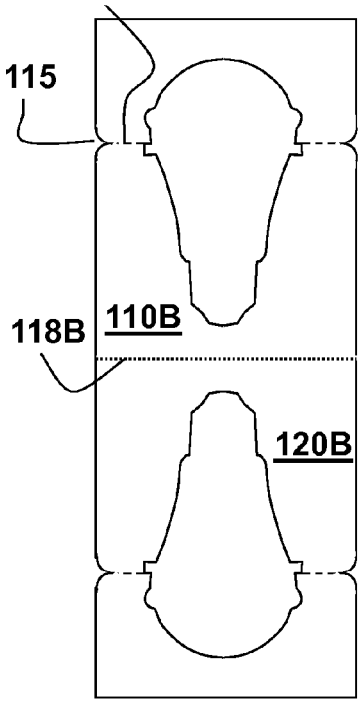
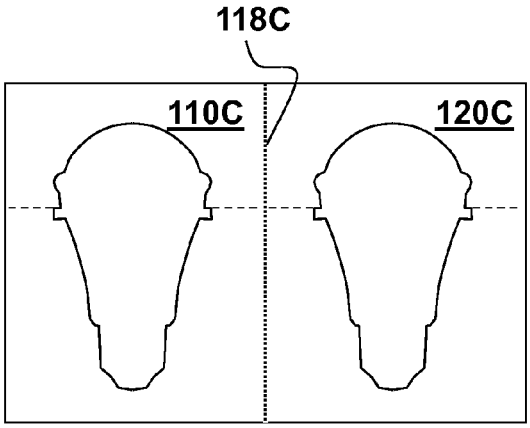
FIG. 8C
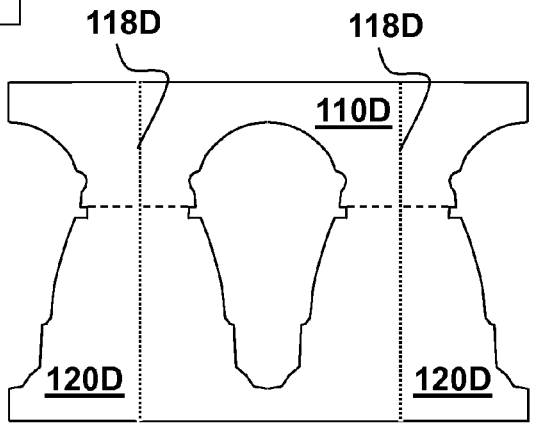
FIG. 8D

FIG. 9A
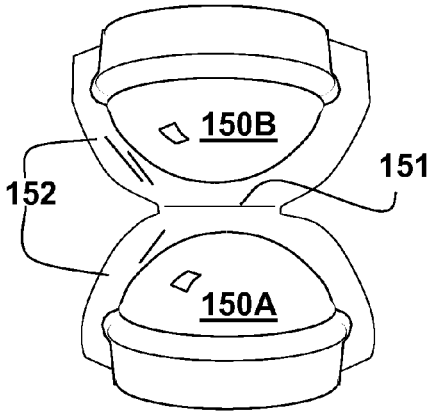
FIG. 9C
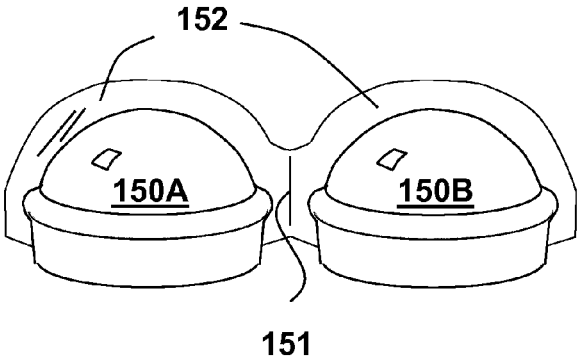
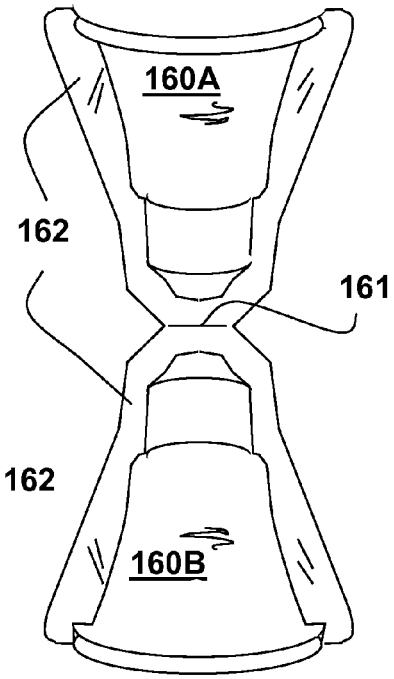
FIG. 9B
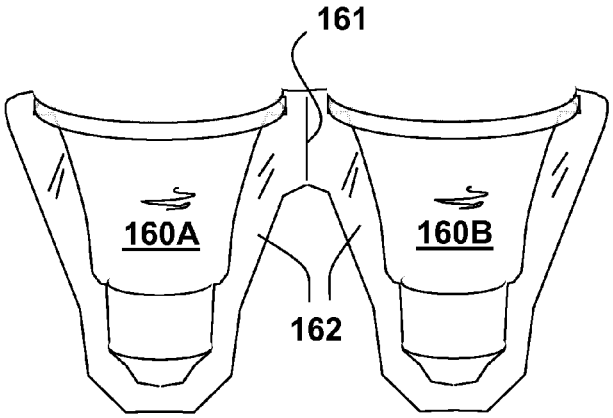
FIG. 9D

FIG. 10C
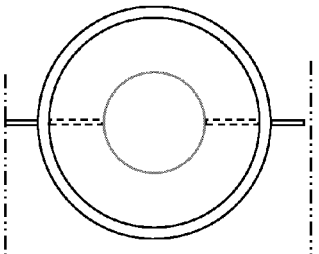
FIG. 10A
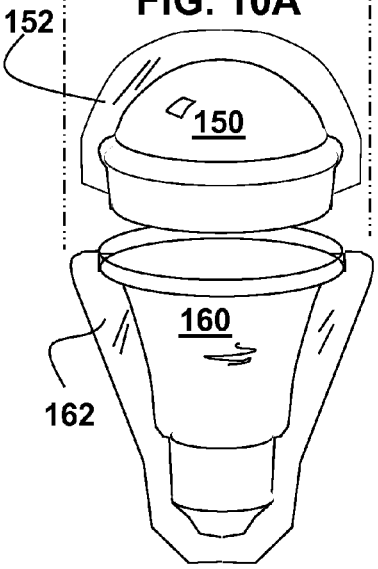
FIG. 10D
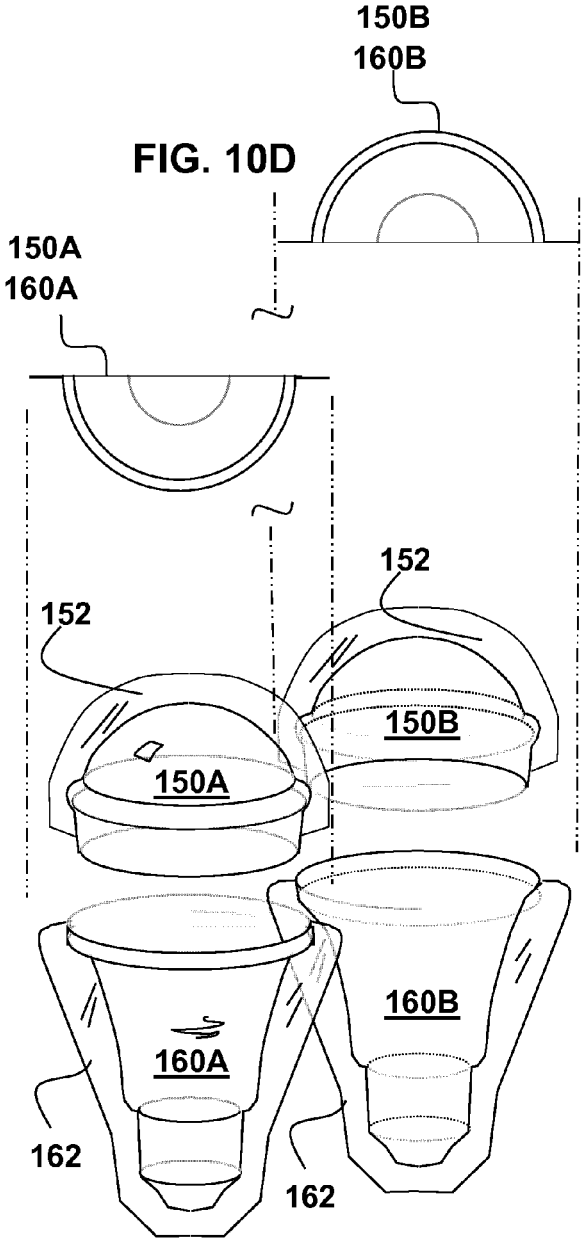
FIG. 10B

RECLOSABLE MULTI-PART BLISTER

REFERENCE TO RELATED APPLICATION

This application is a National Phase entry into the United States of International Application PCT/US12/47788 filed Jul. 23, 2012 which claims the benefit of priority under 35 U.S.C. §119(e) of U.S. provisional application Ser. No. 61/527,400 filed on Aug. 25, 2011, both of which are hereby incorporated by reference in their respective entireties.

BACKGROUND

This disclosure is thus directed to blister packages and, more particularly, to easy-opening blister packages which, after opening, maintain a neat appearance. A package is made of a blister whose flanges are sealed between two paperboard cards. The blister has two halves that may be separated to gain access to the package. The two halves may be held together by the paperboard cards, until the package is opened by a controlled tear or break across the paperboard cards, after which the blister halves may be separated.

The package allows the user easy access, without a tool, into a blister container that is initially sealed. The package may then be placed into a reclosed, unsealed configuration, with good appearance similar to an unopened package.

Manufacturers and retailers of consumer goods, such as pharmaceuticals, software, electronics, health and beauty products and the like, typically package their products in tamper resistant security packages. For example, many consumer goods are packaged in blister or clamshell packages formed by positioning a consumer good in a flanged blister made from various polymeric and/or paperboard materials and sealing the flanged blister between two paperboard substrates. Consumers have voiced disapproval of such packages because of the difficulty of opening the same and the potential for being cut on a rough edge especially of plastic blisters. Packages may therefore be made based largely on paperboard, for example, NATRALOCK packages. Packaging made primarily of paperboard is more sustainable than packaging made from petroleum-based plastics. The paperboard used in such packages may be tear-resistant as described in commonly assigned U.S. Pat. No. 7,144,635.

Some packages may comprise a paperboard card and a polymeric blister. In any case it would be advantageous to have a package that protects its contents well but is fairly easy to open. Advantageously the package may be opened without seriously degrading its appearance. Advantageously the package may also be reclosed after it is opened.

SUMMARY

In one aspect a package is disclosed which includes a blister with first and second portions, the portions being separate pieces, a front card and a back card each made of sheet material and having edges, at least one of the front card and back card including an opening to receive a front or back part of the blister, and a perforation line extending at least partly from one of said edges to a point along said opening.

In certain aspects, the first portion is held a fixed position relative to the second portion when the perforation line is intact, and the first portion is movable relative to the second portion after the perforation line is severed.

In certain aspects, the first portion is formed of a single piece of material folded about a crease line. In certain aspects, the second portion is formed of a single piece of material folded about a crease line.

In certain aspects, the first portion is formed of two or more pieces of material each having a flange, the flanges being brought together in facing relationship to form the first portion. In certain aspects, the second portion is formed of two or more pieces of material each having a flange, the flanges being brought together in facing relationship to form the second portion.

In certain aspects, the blister comprises at least one flange positioned between the front and back cards. In certain aspects, the front and back cards are sealed together.

In certain aspects, there is a non-interference fit between the first blister portion and the second blister portion. In certain aspects, there is a bayonet connection between the first blister portion and the second blister portion. In certain aspects, there is a screw connection between the first blister portion and the second blister portion. In certain aspects, there is a snap fit connection between the first blister portion and the second blister portion.

In certain aspects, the perforation line must be torn before the first blister portion can be moved relative to the second blister portion.

In certain aspects, first and second blister portions move apart through a rotation of the first portion relative to the second portion. In certain aspects, the first and second blister portions move apart through a tilting movement of the first portion relative to the second portion.

In certain aspects, the perforation line is broken by tearing from one of said edges. In certain aspects, the perforation line is broken by flexing or bending along the perforation line. Other aspects of the disclosed package will become apparent from the following description and the accompanying drawings.

BRIEF DESCRIPTION OF THE DRAWINGS

FIGS. 8A-8D show front plan views of various paperboard blanks for making the package;

FIGS. 9A and 9B show front perspective views of blisters for the package;

FIGS. 9C and 9D show front perspective views of other blisters for the package;

FIGS. 10A and 10B show front perspective views of still other blisters for the package;

FIGS. 10C and 10D show top views of the blisters of FIGS. 10A and 10B;

DETAILED DESCRIPTION

Figure 1:
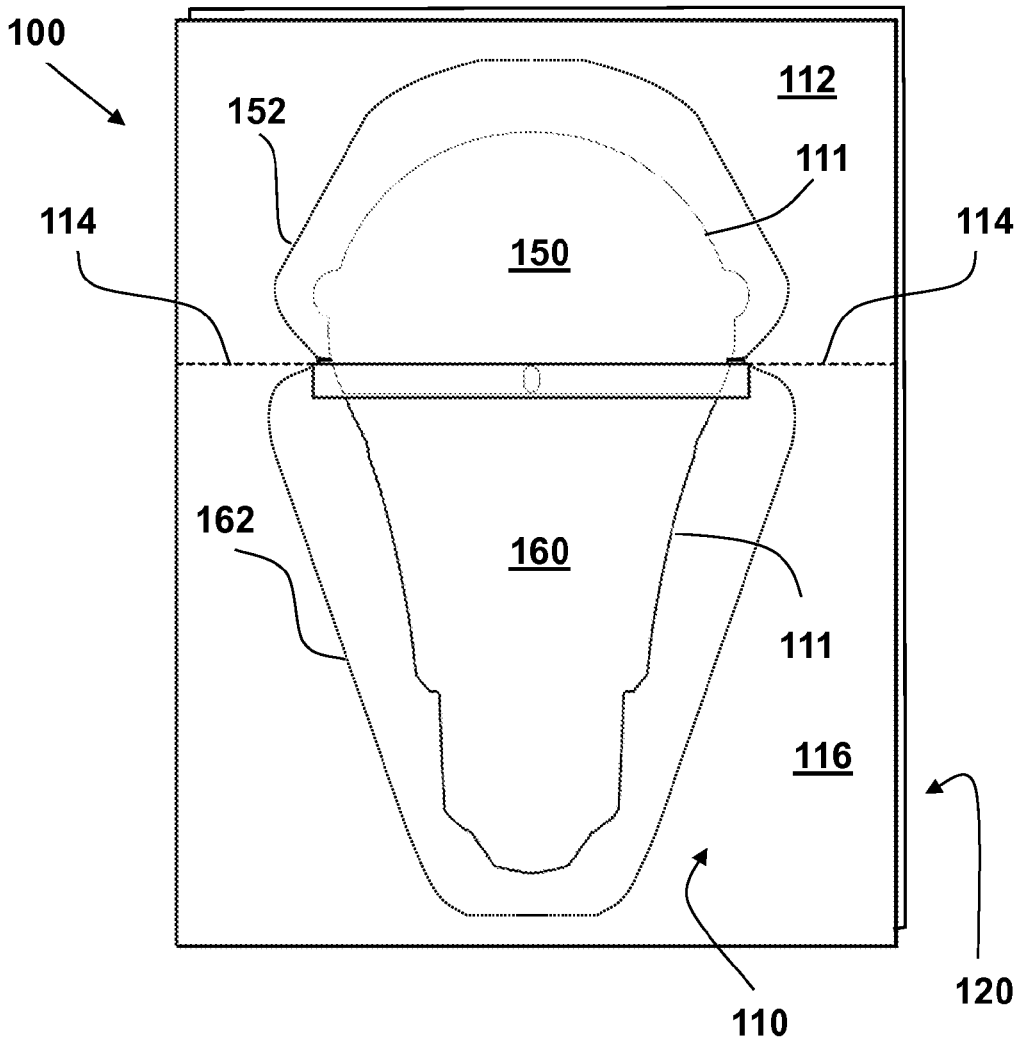
FIG. 1 is a front plan view of a blister package.

As various embodiments of the package are described, reference will be made to FIGS. 1-13. Certain parts of the packages are denoted by reference numerals. Where there is more than one of the same feature, generally only one will be denoted by a reference numeral. Typically in these Figures, where a front plan view is shown for a blank of material, solid lines usually indicate periphery or cuts, and dashed lines usually indicate crease, score, or fold lines. In perspective views, solid lines typically show edges, while dashed lines typically show hidden or partially obscured features. Where assembly steps are described, these steps are exemplary and are not to be limiting as to the sequence of operations used to arrive at the final package. Also, directions such as up, down, top, bottom, front, back, etc. are used for convenience in describing the package and are not meant to be limiting. In most cases the packages described here are made from one blank (that is, the cut sheet parts from which the package components are made by folding and other steps). However, it should be understood that blanks may be provided instead as more than one part. The word "card" or "panel" will often be used to describe a piece of sheet material such as paperboard, particularly with respect to a blank from which the package is made. However, "card" or "panel" may also be used to describe a region of a piece of material, for example a portion of the material that is in a first plane, connected across a fold line with the same material in a second plane. Since panels are sometimes superimposed, for example, creating a two-layer structure, like features or panels will sometime coincide, in which cases, descriptions may call out the number identifying the feature closer to the viewer, that is, the feature visible in a particular Figure.

FIG. 1 shows a front plan view of a package 100 which includes a front card 110, back card 120, and blister including upper blister 150 and lower blister 160. The blisters may include flanges 152, 162 respectively which may be received between the front card 110 and back card 120. The front card 110 and back card 120 may have openings 111 for receiving the blister. A perforation line 114 is provided in both of the front card 110 and back card 120. This perforation line may be considered to divide the front card 110 into a front card upper portion 112 and a front card lower portion 116. The back card 120 may be likewise divided by its perforation line. While "perforation" line is used to describe the line, it should be understood that this line may be formed by scoring, partially cutting, perforating, or otherwise weakening the card so that it is easier to tear the card along the "perforation" line than at other areas of the card.

Figure 2:
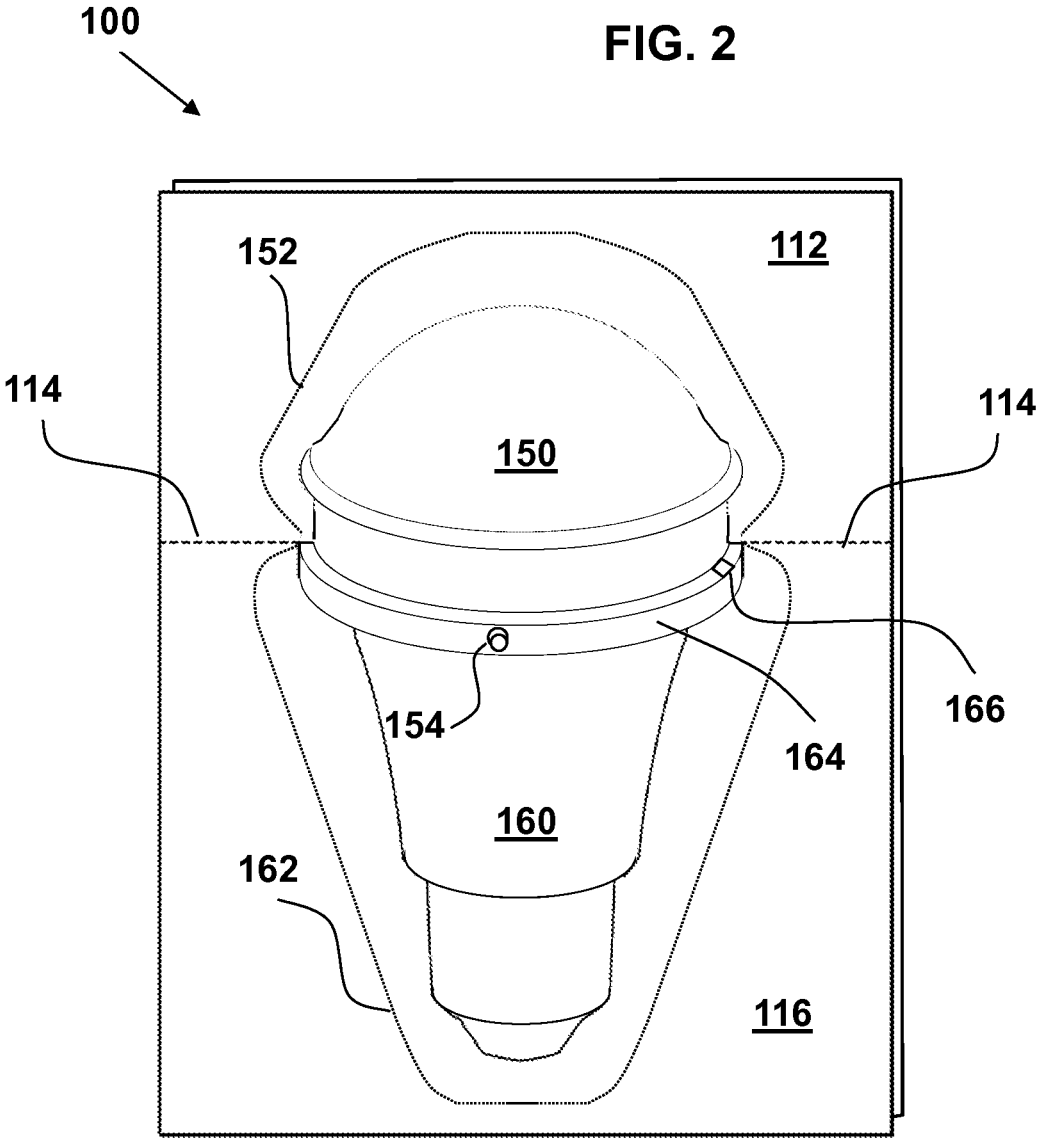
FIG. 2 is a front perspective view of the package.

FIG. 2 shows a front perspective view of package 100. The blister lower portion 160 may have at its upper edge a channel 164 defining an inward-facing annular space in which fits a protrusion 154 from the lower edge of the blister upper portion 150. The channel 164 includes an outlet hole 166 on its upper surface.

Figure 3:
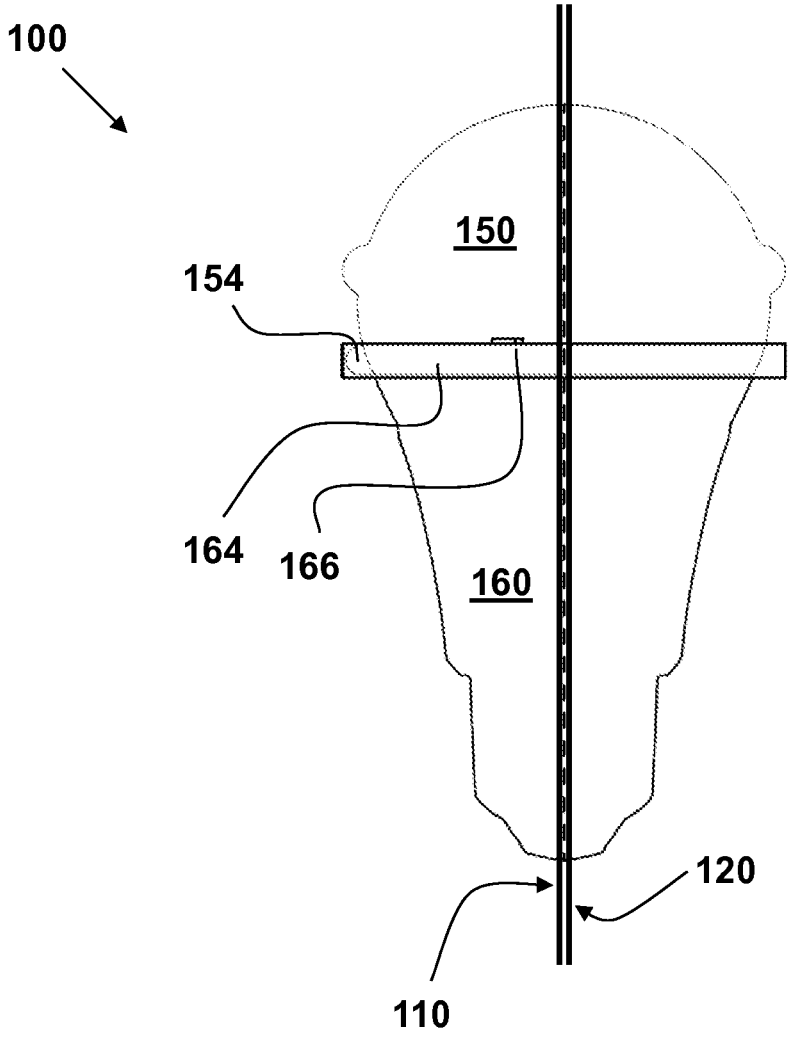
FIG. 3 is a side view of the package.

FIG. 3 shows a side view of package 100 which shows more clearly the back card 120, and also the location of protrusion 154 within channel 164.

Figure 4:
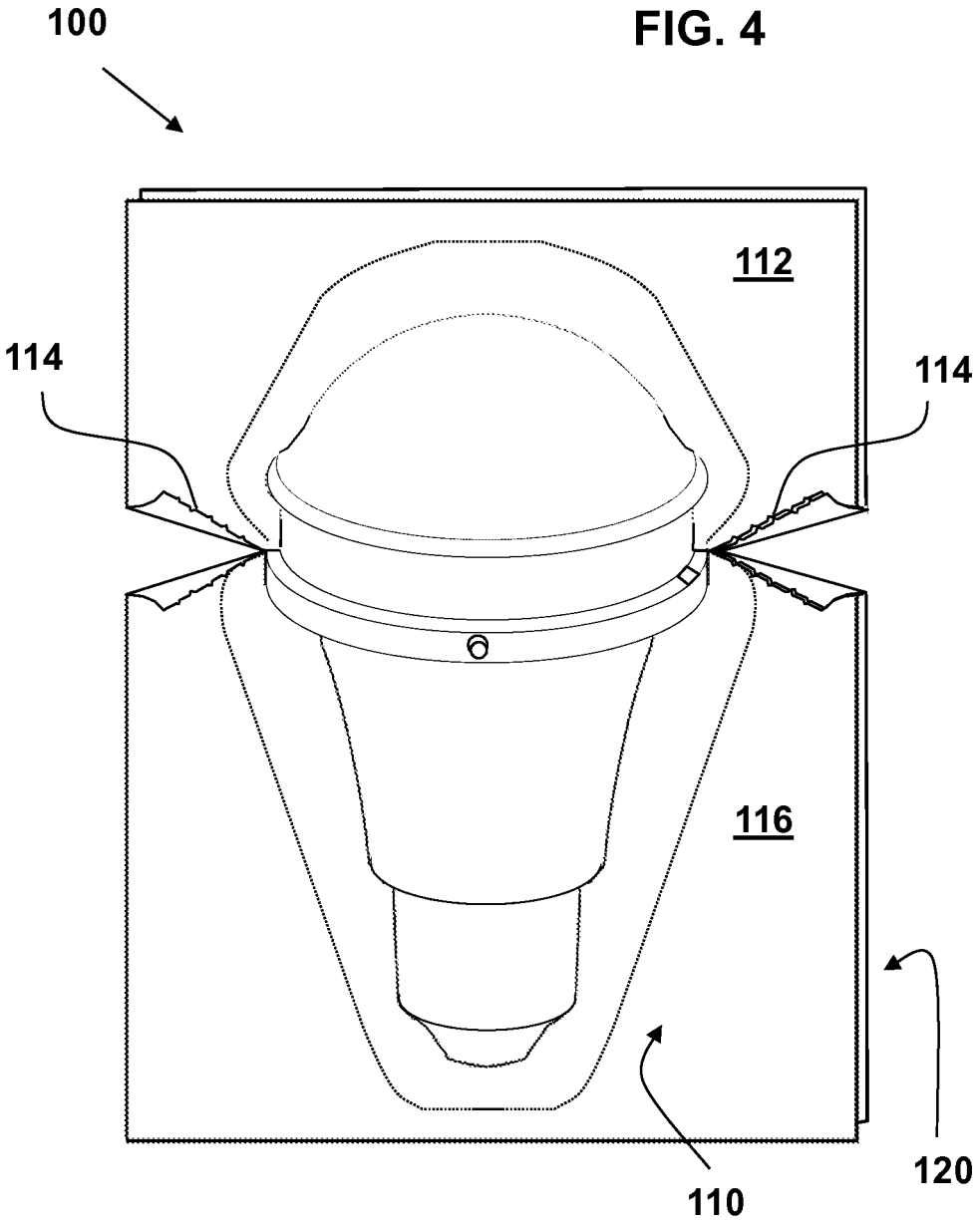
FIG. 4 is a front perspective view of a step in opening the package.

FIG. 4 shows a step in opening package 100. The perforation lines 114 in front card 110 and back card 120 may be torn from the edge of the cards to the blister, separating front card upper portion 112 from front card lower portion 116. Likewise the corresponding portions of the rear card are separated from each other.

Figure 5:
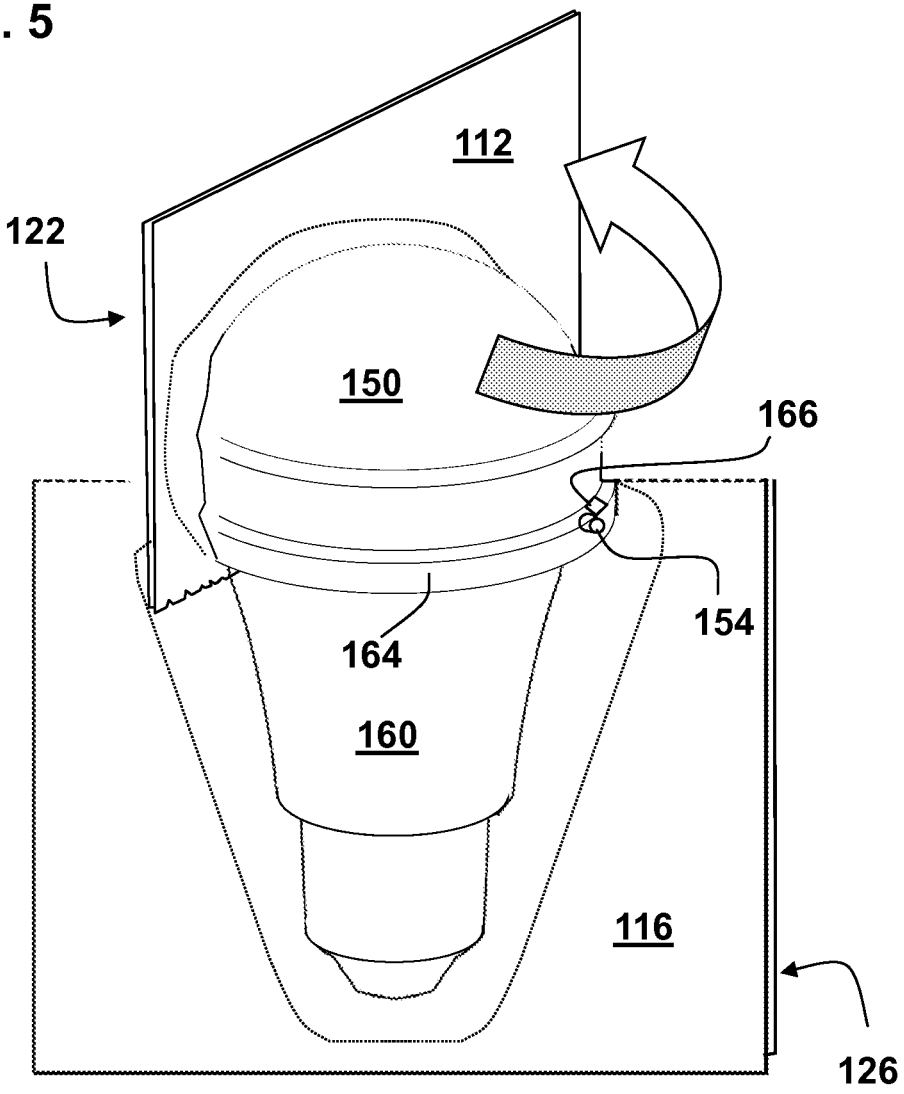
FIG. 5 is a front perspective view of a further step in opening the package.

FIG. 5 shows a further step in opening the package, as the upper part including the upper card portions 112, 122 and the upper blister 150 are rotated so that the protrusion 154 moves circumferentially through channel 164 and reached outlet hole 166. Meanwhile the lower card portions 116, 126 and the lower blister 160 may be considered to be 'stationary' (although both the upper and lower structure can now rotate relative to one another).

Figure 6:
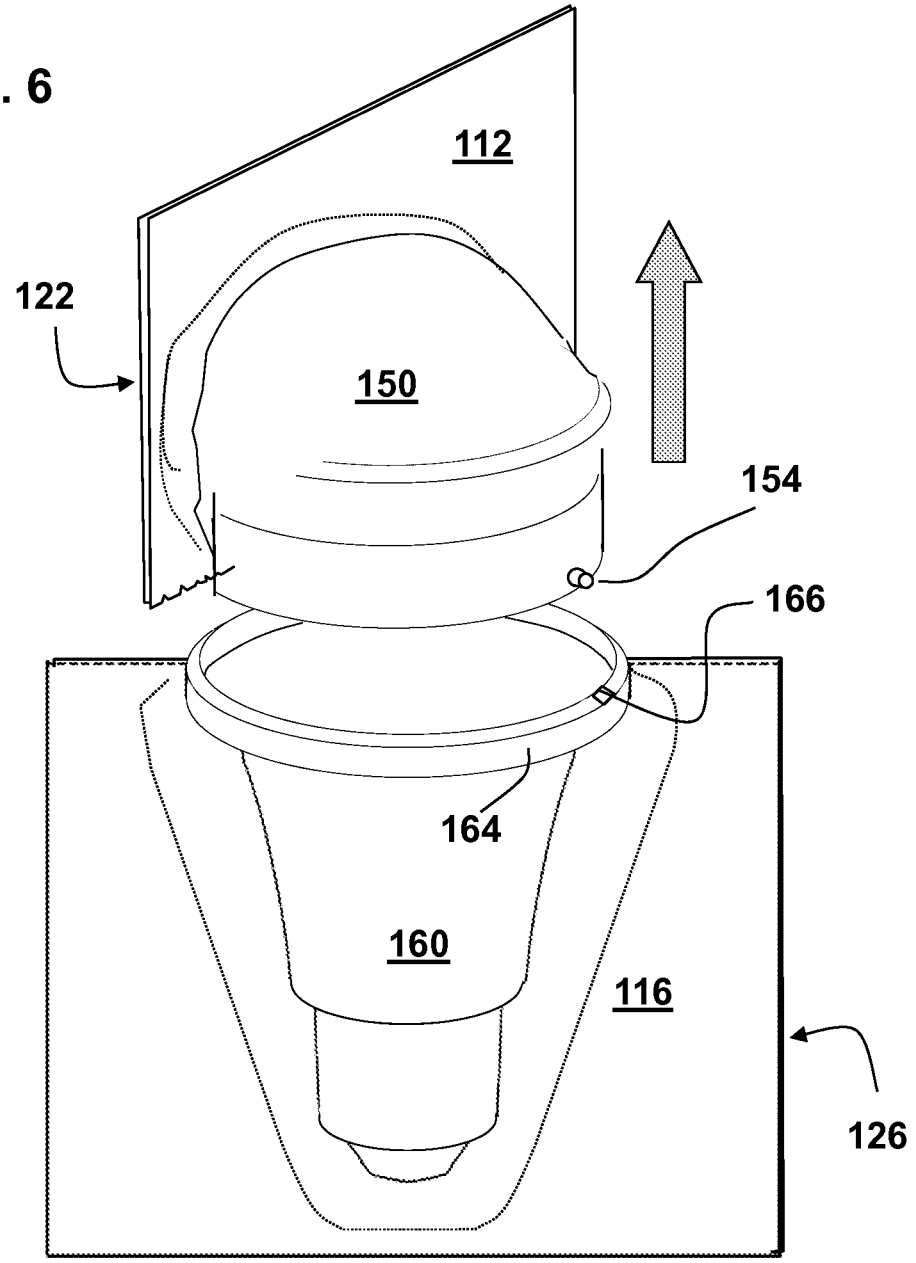
FIG. 6 is a front perspective view of a further step in opening the package.

FIG. 6 shows a further step in opening the package, as the upper part including the upper card portions and upper blister 150 is lifting from the lower portion, which is possible since the protrusion 154 is clear to move through the outlet hole 166.

There may be a protrusion 154, a channel 164, and an outlet hole 166 on the rear parts of the blister as well. There may be more than one protrusion and outlet hole on either the front or back of the blister.

Figure 7:
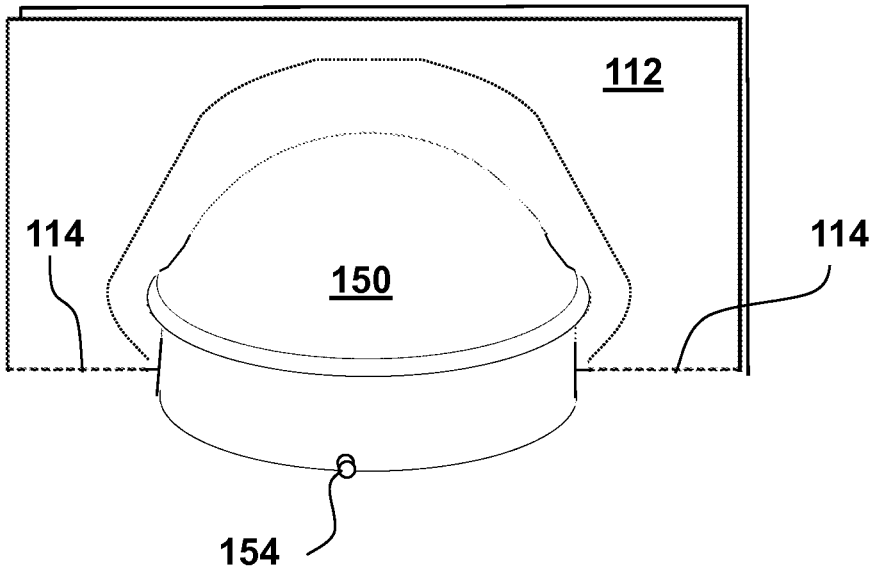
FIG. 7 is a front perspective view of the opened package.
Figure 7:
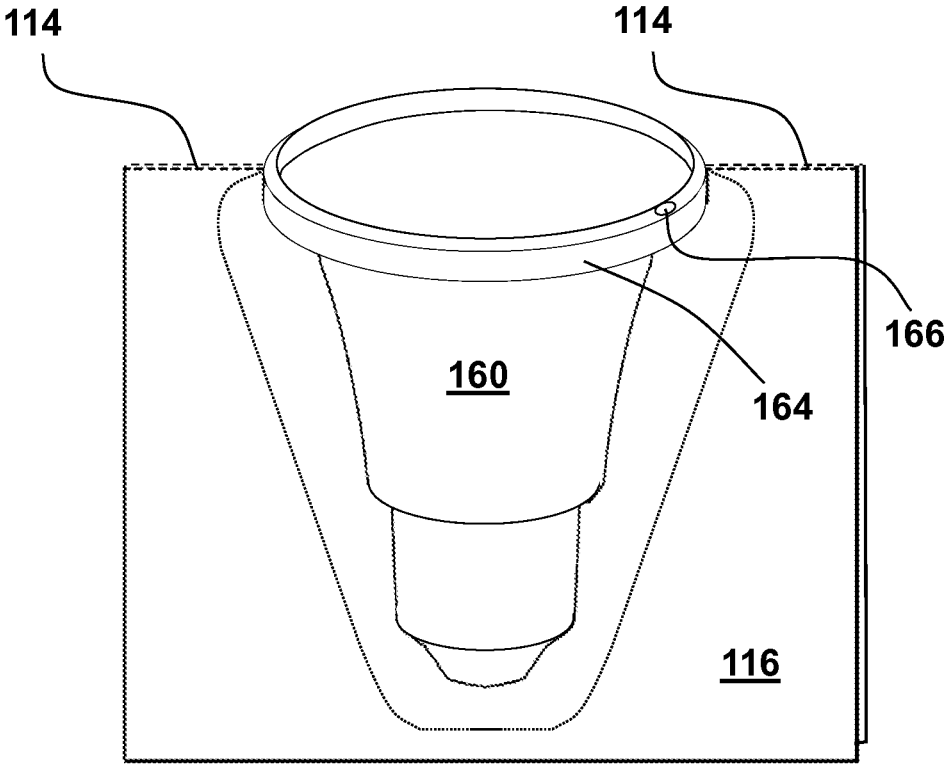

FIG. 7 shows the opened package. Any product contents contained in the blister may now be removed from (or replaced into) the blister. Also, by reversing the steps shown in FIGS. 5 and 6, the package may be reclosed.

FIG. 8A shows a front plan view of front card 110A and back card 120A, similar to those shown in FIGS. 1-7. In this example the front and back cards are separate pieces of material. FIG. 8B shows another embodiment where a single piece of material forms front card 110B and back card 120B which are joined at their bottoms along fold line 118B. FIG. 8C shows another embodiment where a single piece of material forms front card 110C and back card 120C which are joined at their sides along fold line 118C. FIG. 8D shows another embodiment where a single piece of material forms front card 110D and back card halves 120D which are joined at along fold lines 118D. These are only a few examples of how the cards may be formed. As shown in FIG. 8B (but also applicable for any of the embodiments) a notch 115 may be provided at the edge of the perforation line 114 so that it will be easier to start tearing the perforation.

FIGS. 9A and 9B show perspective views of an embodiment of the blister. As shown in FIG. 9A, the blister upper half may be a single piece of material including (approximately) two quarter-spherical portions 150A, 150B hingedly connected by a crease or fold line 151, which when folded "end to end" about the fold line 151, creates an approximately hemispherical blister upper half Shapes other than spherical may also be used. As shown in FIG. 9B, the blister lower half may be a single piece of material including (approximately) two half-conical portions 160A, 160B hingedly connected by a crease or fold line 161, which when folded "end to end" about the fold line 161, creates an approximately conical blister lower half Shapes other than conical may also be used. The size and shape of the associated flanges 152, 162 may be varied according to manufacturing preference, as may the distance between the fold lines 151, 161 and the respective (e.g. spherical or conical) body portions of the blister.

FIGS. 9C and 9B show perspective views of another embodiment of the blister, similar in some regards to FIGS. 9A and 9B, but folded about a different axis. As shown in FIG. 9C, the blister upper half may be a single piece of material including (approximately) two quarter-spherical portions 150A, 150B hingedly connected by a crease or fold line 151, which when folded "side to side" about the fold line 151, creates an approximately hemispherical blister upper half Shapes other than spherical may also be used. As shown in FIG. 9D, the blister lower half may be a single piece of material including (approximately) two half-conical portions 160A, 160B hingedly connected by a crease or fold line 161, which when folded "side to side" about the fold line 161, creates an approximately conical blister lower half Shapes other than conical may also be used. The size and shape of the associated flanges 152, 162 may be varied according to manufacturing preference, as may the distance between the fold lines 151, 161 and the respective (e.g. spherical or conical) body portions of the blister.

FIGS. 10A and 10B show perspective views of two other embodiments of the blister. As shown in FIG. 10A, the blister upper half 150 may be a single piece of material with flange 152, and the blister lower half 160 may be a single piece of material with flange 162. A corresponding top view of the blister is shown in FIG. 10C. Forming the blister halves this way might, for example, be suited to an injection molding process. As shown in FIG. 10B, the blister upper half may be two (or more) pieces 150A, 150B with either or both having a flange 152. Likewise the blister lower half may be two (or more) pieces 160A, 160B with either or both having a flange 162. A corresponding top view of the blister is shown in FIG. 10D. Forming the blister halves this way might, for example, be suited to a thermoforming or vacuum forming process. As another option, the upper blister half might be constructed in one piece (as in FIG. 10A) while the lower blister half might be constructed in two pieces (as in FIG. 10B), or vice versa.

FIGS. 11A-11D show various joint designs for the blister. FIG. 11A again shows the joint between the upper blister half and lower blister half with the protrusion 154 within channel 164 which has outlet hole 166. Such a structure might be considered a "bayonet connector." FIG. 11B again shows another joint between the upper blister half and lower blister half with a longer protrusion 154 within channel 164 which has larger outlet hole 166. Such a structure might also be considered a "bayonet" construction, and may provide more strength than the structure of FIG. 11A.

Figure 11A:
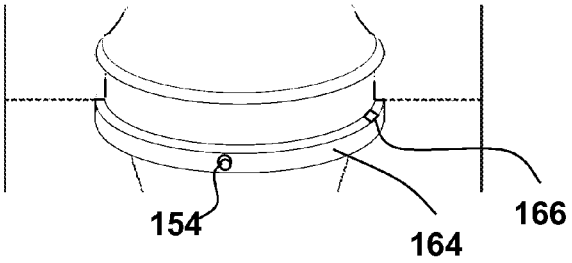
FIGS. 11A-11D show front perspective views of various means of holding closed the blister
Figure 11B:
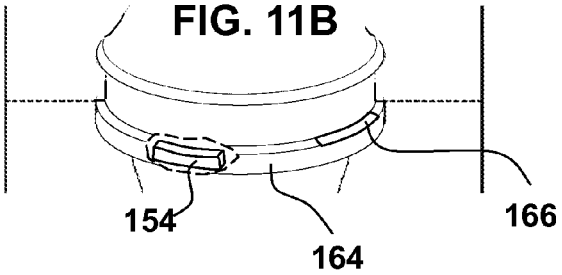
Figure 11C:
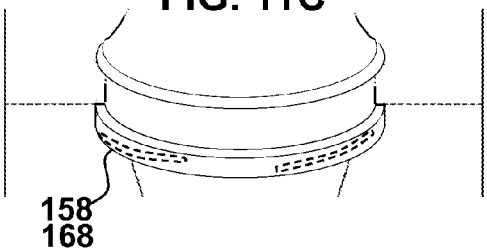

FIG. 11C shows an alternative type of joint, where one or both of the blister halves may be held together at their juncture by one or more thread portions 158, 168 with which, through a rotational movement, the blister halves can be separated apart or rejoined back together. This may be considered a "screw" connection.

Figure 11D:
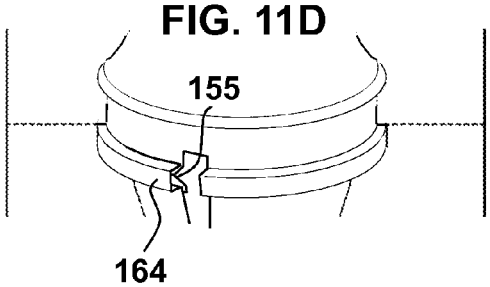

FIG. 11D shows an alternative type of joint, which may be considered a "snap fit" where one or both of the blister halves may be held together at their juncture by interlocking features, such as if the lower edge of the blister upper portion has one or more outward protrusions 155 (shown in cutaway view) that snap into channel 164 and with which, through an axial translation movement, the blister halves can be separated apart or rejoined back together.

It should be understood that the blister upper and lower halves may simply fit together with different types or shapes of bayonet, screw-in, or snap connections, or may fit together without having a bayonet, screw-in, or snap in connection. Such a 'free fitting connection could be achieved, for example, by omitting the protrusion 154 in FIGS. 1-7 or by omitting the protrusion 155 in FIG. 11D. It is understood that a 'free-fitting' connection might not be reclosable in the manner that can be achieved by bayonet, screw-in, or snap-in blister halves.

Although the examples shown herein depict blisters whose juncture is a circular form, it should also be understood that the package may use blisters with a non-circular junction between the blister halves. For such 'non-circular' packages, bayonet or screw-in connections as in FIGS. 11A-11C might be less useful, but snap-in (e.g. FIG. 11D) or 'free-fitting' connections would be easily achieved.

Figure 12A:
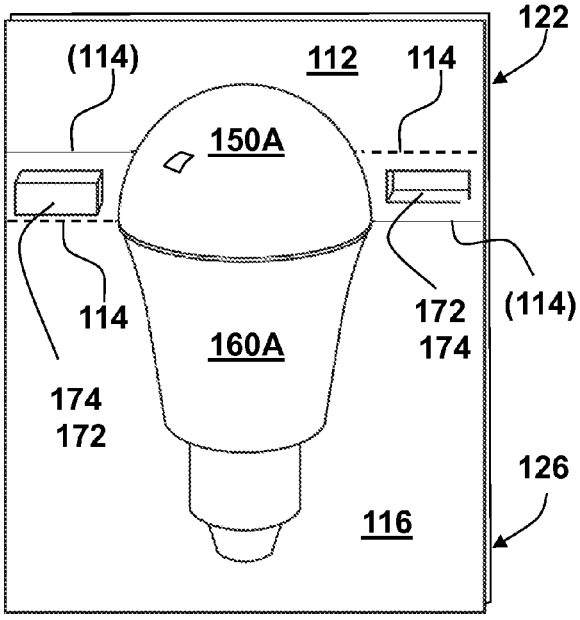
FIGS. 12A-12E show views of another type of blister package.
Figure 12C:
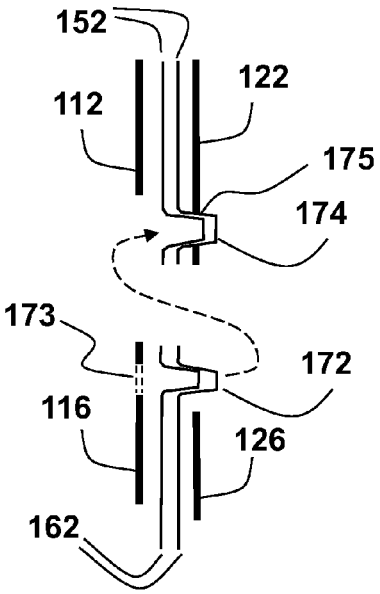
Figure 12B:
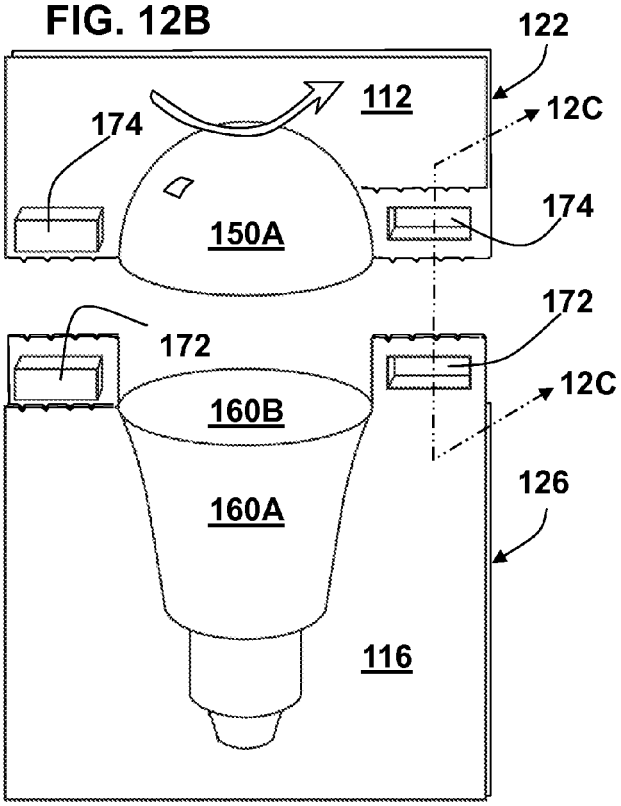
Figure 12D:
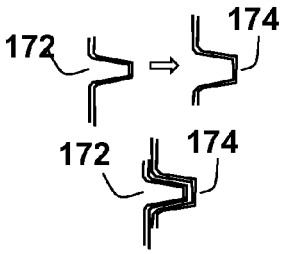

FIGS. 12A-12E show another package. FIG. 12A shows the package before opening. FIG. 12B shows the package after opening, with FIGS. 12C-12D being detail cross sections of the construction. The blister may be formed similarly to those already discussed, for example including an blister upper portion 150A and blister lower portion 160A situated in front of the front card (and corresponding upper and blister lower portions situated behind the back card). Mating fitments may be formed in the flanges (not shown) such as projection 172 and recess 174 that fit together to help hold the blister halves together before and after unsealing the package. Perforation lines 114 are provided in the front card 112,116 and in the back card 122,126. The perforation lines 114, rather than being superimposed as in previous examples, may be offset as shown in FIGS. 12A and 12B. To help tear through these or other perforation lines described herein, a tear tab or supplemental perforation lines may be provided. Once the perforation lines have been severed, twisting the blister upper portion 150A as shown will back the projections 172 out of recesses 174 so that the blister upper portion may be detached from the blister lower portion. However, by placing the upper and blister lower portions together and twisting in the opposite direction, projections 172 may be seated again into recesses 174 to 'close' the blister container.

The package of FIGS. 12A-12D is substantially a structure of front and back cards sealed together with blister flanges between the cards. However, as shown in FIG. 12B, the offset perforation lines 114 may result in the package having a single ply of card (either part of the front or the back card) in the vicinity of the perforation lines 114 and the mating fitments (projection 172, recess 174). However, the package could also be constructed so that after tearing the perforation lines 114 (and possibly additional perforation lines nearby) the mating fitments might include just one or two layers of blister flange without and ply of the card.

FIG. 12C, a cross section through the location denoted '12C', shows the offset nature of the cards in the vicinity of the mating fitments. For example (at the location of the cross section detail) front card upper portion 112 does not extend as far downward as back card upper portion 122. Thus the recess 174, formed in flange or flanges 152, may have an open front to receive projection 172. Likewise, back card lower portion 126 does not extend as far upward as front card lower portion 116. Thus the projection 172, formed in flange or flanges 162, may project freely in order to fit into recess 174. There may be an opening 175 formed in the back card upper portion 122 for passage of recess 174. There may also be an opening 173 formed in the front lower portion 116 but such an opening is not necessarily required because the projection 172 is directed away from the front card 116.

Figure 12E:
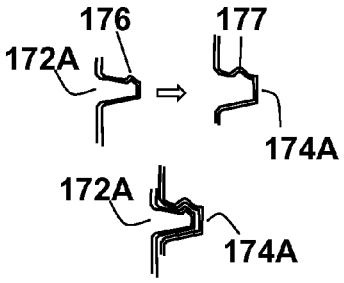

FIG. 12E shows an alternative construction of a projection 172A and recess 174A, where the projection 172A has a shaped feature 176 such as a bump and the recess 174A has a corresponding shaped feature 177 such as an indentation to receive the bump. The projection and recess, besides fitting together, may thus also 'click' together and require some additional force to separate the projection and recess.

Figure 13A:
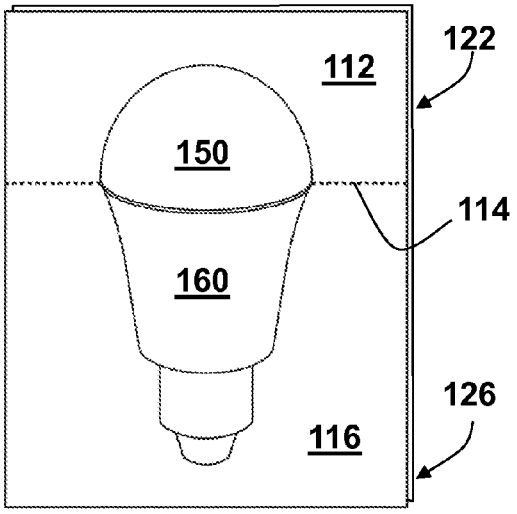
FIGS. 13A-13D show views of yet another type of blister package.
Figure 13B:
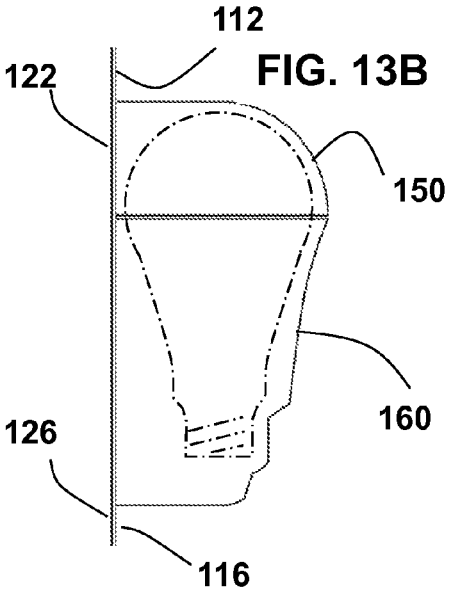
Figure 13C:
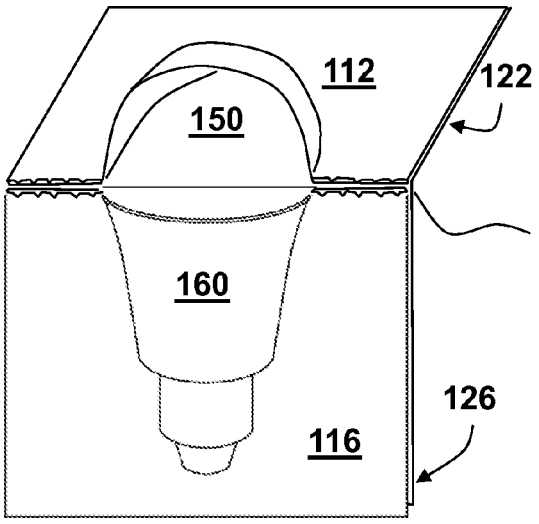
Figure 13D:
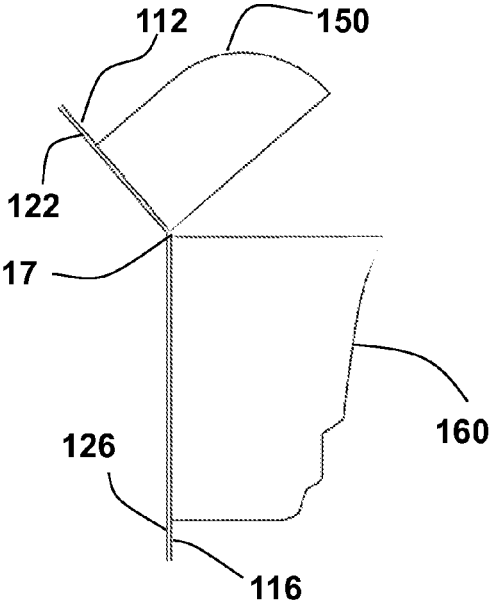

FIGS. 13A and 13B show front and side views of another package before opening. The package is in some respects similar to certain packages already described. For example it includes a front card upper portion 112 and front card lower portion 116 with perforation line 114 between them. This perforation line 114 need not be provided between the back card upper portion 122 and back card lower portion 126, although a crease or fold line 117 may be provided instead. FIG. 13A shows a front view and FIG. 13B a side view of the package before opening. The blister 150, 160 may extend only to the front of the package. To open the package, the front card upper portion 112 and back card upper portion 122 are bent back, breaking the perforation line 114, which allows the blister upper half 150 to tilt back from the blister lower half 160, thus opening the package. The fold line 117 in the back card may thus provide a hinge for opening and closing the package.

As shown in FIG. 13A, the blister halves may meet along the plane of the perforation line 114, without being connected. However, if desired, the blister halves 150, 160 may fit together by a snap fit as shown in FIG. 11D. Such a snap fit may allow the package to be reclosed and held shut, even after opening.

Although the blister constructions shown here generally are for a blister that completely encloses a product, it is also contemplated that portions of the blisters may be left open, for example to allow a customer to handle the product such as feeling the texture, observing the product directly (without looking through the blister material), testing a fit (e.g. for an electrical connection), and for other purposes.

The packages as described herein may be closed and sealed once the contents are placed inside the blister. Once the blister parts are connected together with the contents inside, the blister may be placed into the openings 111 in the front card 110 and back card 120, with flanges 152, 162 sandwiched between the cards. The cards (and flanges) may then be joined together by heat sealing, adhesive, staples, or other suitable method.

The front card 110 and back card 120 may be formed of a sheet material such as paperboard, which may be made of or coated with materials to increase its strength. An example of such a sheet material is EASYSEAL paperboard made by MeadWestvaco Corporation. The sheet material may have a heat sealable coating, for example to allow a heat seal to be created between the front card 110 and back card 120. Alternately, other forms of adhesive may be used to seal these flaps together. It should be noted that the use of tear resistant materials, and/or in more than one layer, help to improve the tamper- and theft-resistance of the package. The cards may be joined together by heat sealing, RF (radio frequency) sealing, ultrasonic sealing, adhesive, or other means. Such sealing may be done on most of the facing surfaces of the front and back cards or sealing may be done to less than the entire facing surfaces, for example only around the outer perimeter of the card, and along or upon part or all of flanges 152, 162.

Blister 150, 160 may be made with common thermoform plastics such as PVC or APET but may also include a recycled material such as RPET or a biodegradable material such as PLA. However other materials including other plastics or paperboard may also be used. Besides thermoforming, the case or blister may be formed by injection molding or other manufacturing methods.

It should be understood that additional cards or fold-over panels may be included in the package for further reinforcing the package.

The invention claimed is:

1. A packaging structure comprising:

a blister comprising a first portion and a second portion, the portions being separate pieces;

a front card comprised of sheet material and having edges;

a back card comprised of sheet material and having edges;

at least one of the front card and back card comprising an opening to receive a front or back part of the blister, and a perforation line extending at least partly from one of said edges to a point along said opening;

wherein the first portion is formed of two or more pieces of material each having a flange, the flanges being brought together in facing relationship to form the first portion.

2. The package of claim 1, in which the first portion is held a fixed position relative to the second portion when the perforation line is intact, and the first portion is movable relative to the second portion after the perforation line is severed.

3. The package of claim 1, in which the first portion is formed of a single piece of material folded about a crease line.

4. The package of claim 1, in which the second portion is formed of a single piece of material folded about a crease line.

5. The package of claim 1, in which the second portion is formed of two or more pieces of material each having a flange, the flanges being brought together in facing relationship to form the second portion.

6. The package of claim 1, wherein the blister comprises at least one flange positioned between the front and back cards.

7. The package of claim 1, wherein the front and back cards are sealed together.

8. The package of claim 1, having a non-interference fit between the first blister portion and the second blister portion.

9. The package of claim 1, having a bayonet connection between the first blister portion and the second blister portion.

10. The package of claim 1, having a screw connection between the first blister portion and the second blister portion.

11. The package of claim 1, having a snap fit connection between the first blister portion and the second blister portion.

12. The package of claim 1, wherein the perforation line must be torn before the first blister portion can be moved relative to the second blister portion.

13. The package of claim 2, wherein the moving apart comprises a rotation of the first portion relative to the second portion.

14. The package of claim 2, wherein the moving apart comprises a tilting movement of the first portion relative to the second portion.

15. The package of claim 1, wherein the perforation line is broken by tearing from one of said edges.

16. The package of claim 1, wherein the perforation line is broken by flexing or bending along the perforation line.

17. A packaging structure comprising:

a blister comprising a first portion and a second portion, the portions being separate pieces;

a front card comprised of sheet material and having edges;

a back card comprised of sheet material and having edges;

at least one of the front card and back card comprising an opening to receive a front or back part of the blister, and a perforation line extending at least partly from one of said edges to a point along said opening, wherein the first portion is held a fixed position relative to the second portion when the perforation line is intact, and the first portion is movable relative to the second portion after the perforation line is severed, and wherein the moving apart comprises a rotation of the first portion relative to the second portion.

18. A packaging structure comprising:

a blister comprising a first portion and a second portion, the portions being separate pieces;

a front card comprised of sheet material and having edges;

a back card comprised of sheet material and having edges;

at least one of the front card and back card comprising an opening to receive a front or back part of the blister, and a perforation line extending at least partly from one of said edges to a point along said opening, wherein the first portion is held a fixed position relative to the second portion when the perforation line is intact, and the first portion is movable relative to the second portion after the perforation line is severed, and wherein the moving apart comprises a tilting movement of the first portion relative to the second portion.

* * * * *